United States Patent [19]

Douglas, III

[11] Patent Number: 4,627,372

[45] Date of Patent: Dec. 9, 1986

[54] FLOTATION HULL AND BOATS MADE THEREFROM

[76] Inventor: Otis W. Douglas, III, 5218-C Castlewood Rd., Richmond, Va. 23234

[21] Appl. No.: 745,497

[22] Filed: Jun. 17, 1985

[51] Int. Cl.[4] ..... B63B 7/04

[52] U.S. Cl. ..... 114/61; 114/77 R; 114/352

[58] Field of Search ..... 114/39, 61, 77 R, 77 A, 114/292, 352, 356, 358, 56; 441/44–46

[56] References Cited

U.S. PATENT DOCUMENTS

| | | | |
|---|---|---|---|
| 33,598 | 10/1861 | Pardee | 114/61 |
| 121,275 | 11/1871 | Calkin | 441/45 |
| 585,508 | 6/1897 | Clark | 441/45 |
| 1,587,209 | 6/1926 | Bauer | 114/61 |
| 1,684,187 | 9/1928 | Loening | 114/356 X |
| 1,822,199 | 9/1931 | Carns | 114/356 |
| 2,480,144 | 8/1949 | Laycock | 114/49 |
| 2,605,733 | 8/1952 | Smith | 114/77 R |
| 2,748,740 | 6/1956 | Villar | 114/61 X |
| 2,977,606 | 4/1961 | Straussler | 114/61 X |
| 3,656,445 | 4/1972 | Padwick | 114/102 X |
| 3,883,909 | 5/1975 | Fisher et al. | 114/61 |

*Primary Examiner*—Sherman D. Basinger
*Attorney, Agent, or Firm*—Norman B. Rainer

[57] ABSTRACT

Flotation hulls are fabricated from at least one pontoon unit of block-like configuration having four flat side walls of rectangular configuration and bulkhead end walls positioned at the extremities of the side walls. Several pontoon units may be assembled end-wise by joinder of the bulkhead end walls. A nose piece is attached to each terminal end wall of a sequence of one or more pontoon units. The nose piece has a four sided pyramidal shape having a pointed extremity directed away from the pontoon units. Boats can be fabricated using one or more of the hulls by orienting the hulls V-shaped downwardly. When two or more hulls are utilized in a boat, the hulls are held together in parallel disposition by cross arms which penetrate the hulls and attach to the bulkhead end walls.

12 Claims, 5 Drawing Figures

FLOTATION HULL AND BOATS MADE THEREFROM

BACKGROUND OF THE INVENTION

This invention relates to improvements in flotation hulls, and boats comprising said hulls.

Hollow, water impervious floating pontoons of various design have long been used in the construction of temporary bridges and in other flotation applications. Unlike the hull of a boat, pontoons are not generally streamlined for efficient passage through water but are instead usually designed for maximum flotation effect and stability at anchor.

Because of the many factors involved in the design of streamlined hulls for boats, especially the use of curved surfaces of considerable complexity, such hulls are costly and not easily fabricated without sophisticated equipment and techniques.

It is accordingly an object of the present invention to provide a flotation hull fabricated from pontoon-like structural units.

It is another object of this invention to provide a hull as in the foregoing object wherein said pontoon-like structural units are constructed of rectangular flat panels.

It is a further object of the present invention to provide a boat comprised of two or more hulls of the aforesaid nature.

It is still another object of this invention to provide improved boat hulls of simple and rugged construction which may be economically fabricated.

These objects and other objects and advantages of the invention will be apparent from the following description.

SUMMARY OF THE INVENTION

The above and other beneficial objects and advantages are accomplished in accordance with the present invention by a flotation hull comprised of an assembly of:

(a) at least one pontoon unit of block-like configuration comprised of four flat side walls of rectangular configuration joined at their edges to form four parallel side corners, and two bulkhead end walls of square configuration positioned at the extremities of said side walls in perpendicular relationship thereto and forming end corners therewith, said end walls being adapted to permit joinder of adjacent pontoon units in a manner such that their end walls are in close parallel juxtaposition while the side walls of adjacent pontoon units are in coplanar alignment, and (b) a nose piece attached to each terminal end wall of a sequence of one or more pontoon units, said nose piece having a four sided pyramidal shape with a base periphery congruent with the end corners of said terminal end wall, the pointed extremities of said nose pieces being directed away from said pontoon units, (c) said assembly being impervious to entrance of water into the interior thereof.

Boats of the present invention are comprised of at least one hull of the aforesaid nature, and preferably at least two hulls in parallel disposition and oriented in a manner such that a first side corner of each pontoon unit is downwardly directed in V-shaped disposition, placing a second side corner directly thereabove in a vertical plane, while the third and forth side corners are disposed in a horizontal plane. The hulls are interconnected by cross arms which may penetrate the hulls and attach to said end walls. Suitable boat styles include catamaran sailing boats, houseboats, floating docks, ferryboats, fishing boats and dive boats.

In preferred embodiments of the invention, the pontoon units are fabricated of plywood panels having resistance to delamination by exposure to water. The panels are preferably of a 4′ by 8′ size which is commonly popular in the building industries. The panels are preferably interconnected with the aid of strips of wood of rectangular cross-section placed in abutment with the interior of the side corners. Attachment of the panels to the wood strips may be achieved with penetrative fasteners such as screws and nails, or by adhesive agents. A water impervious coating covers the entire exterior of the hull. In other embodiments, the panels may be steel sheet interconnected by welding.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
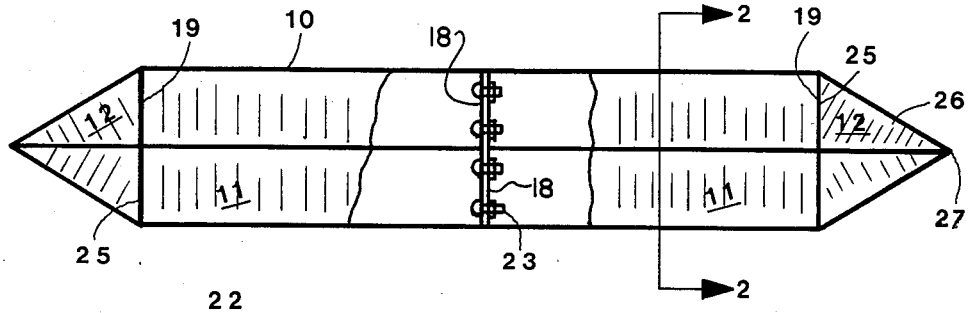
FIG. 1 is a top view of an embodiment of a boat hull of the present invention with portions broken away to reveal internal detail.

Referring to FIG. 1, a boat hull assembly 10 of this invention is shown comprised of two pontoon units 11 and two nose pieces 12.

Figure 2:
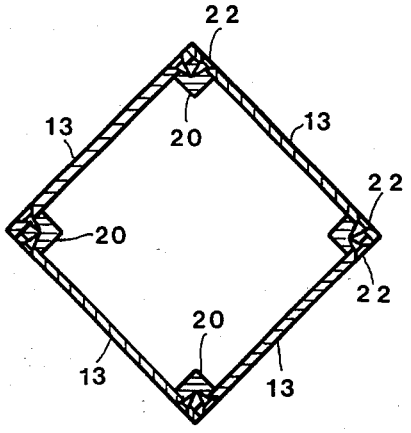
FIG. 2 is a sectional view taken along the line 2—2 of FIG. 1.
Figure 3:
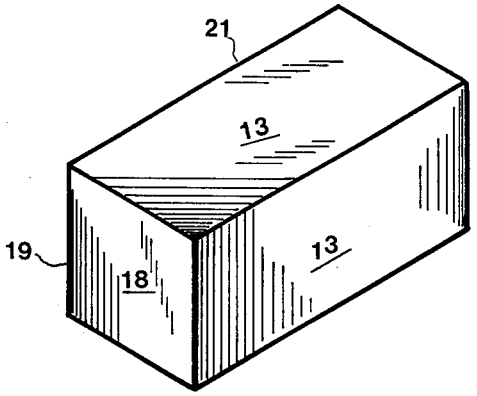
FIG. 3 is a perspective view of one of the pontoon units employed in the hull of FIG. 1.
Figure 4:
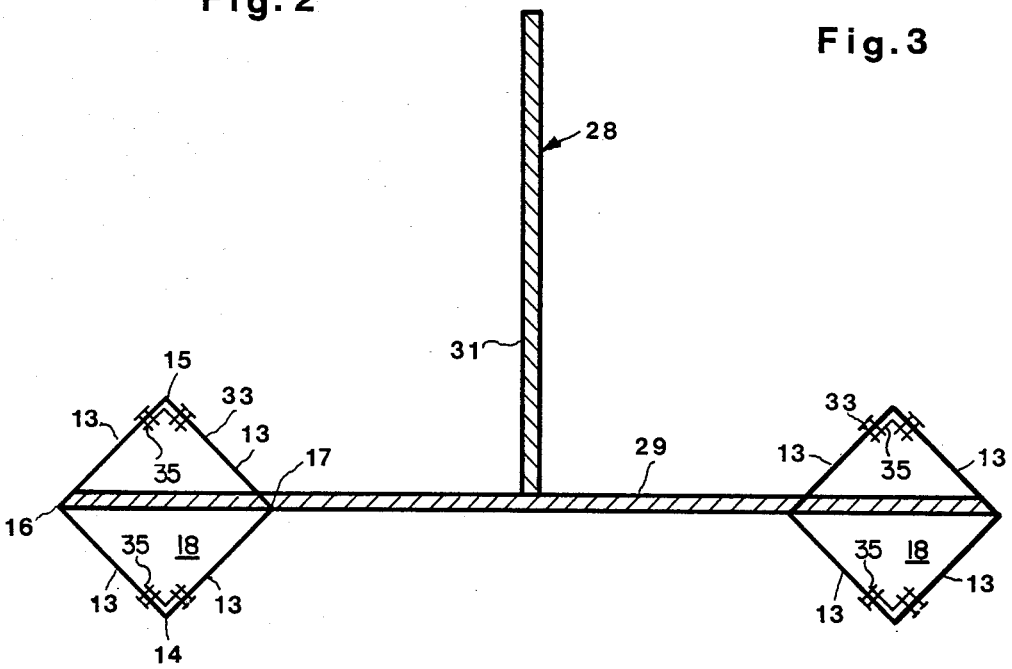
FIG. 4 is a vertical sectional view of an embodiment of a catamaran boat of this invention comprised of two hulls of the nature shown in FIG. 1.

As shown more clearly in FIGS. 2, 3 and 4, each pontoon unit is comprised of four flat side panels 13 of rectangular configuration joined at their long edges 21 to form horizontally disposed side corners 14, 15, 16 and 17. Bulkhead end walls 18, having a square configuration in the illustrated embodiment, are positioned at the horizontal extremities of said side walls in perpendicular relationship thereto, and form therewith end corners 19 disposed in a vertical plane. In other embodiments, end walls 18 may have a diamond shape. The joinder of said side panels is aided by abutment strips 20 of square cross section associated with each side corner within the interior of the pontoon unit. Accordingly, said side panels are held together by the use of wood screws 22 which penetrate said panels and enter said abutment strips. To ensure strong joinder, waterproof adhesive is applied between the side panels and abutment strips at the time of their interconnection.

In the hull of FIG. 1, two bulkhead end walls 18 of adjacent pontoons are joined by bolts 23 in a manner such that said end walls are in close parallel relationship while the side walls of the two interconnected pontoons are in coplanar alignment.

A nose piece 12 is attached to each of the two terminal end walls 25, said nose piece having four identical triangular faces 26 forming a pyramidal shape. The pointed extremity 27 of the nose piece is directed away from the pontoons. The base of each triangular face is equal in length to end corners 19, to which said bases are attached by means of conventional fastening means.

The entire hull assembly may be coated with a water-impervious layer of fiberglass-reinforced polyester composition or equivalent compositions.

Figure 5:
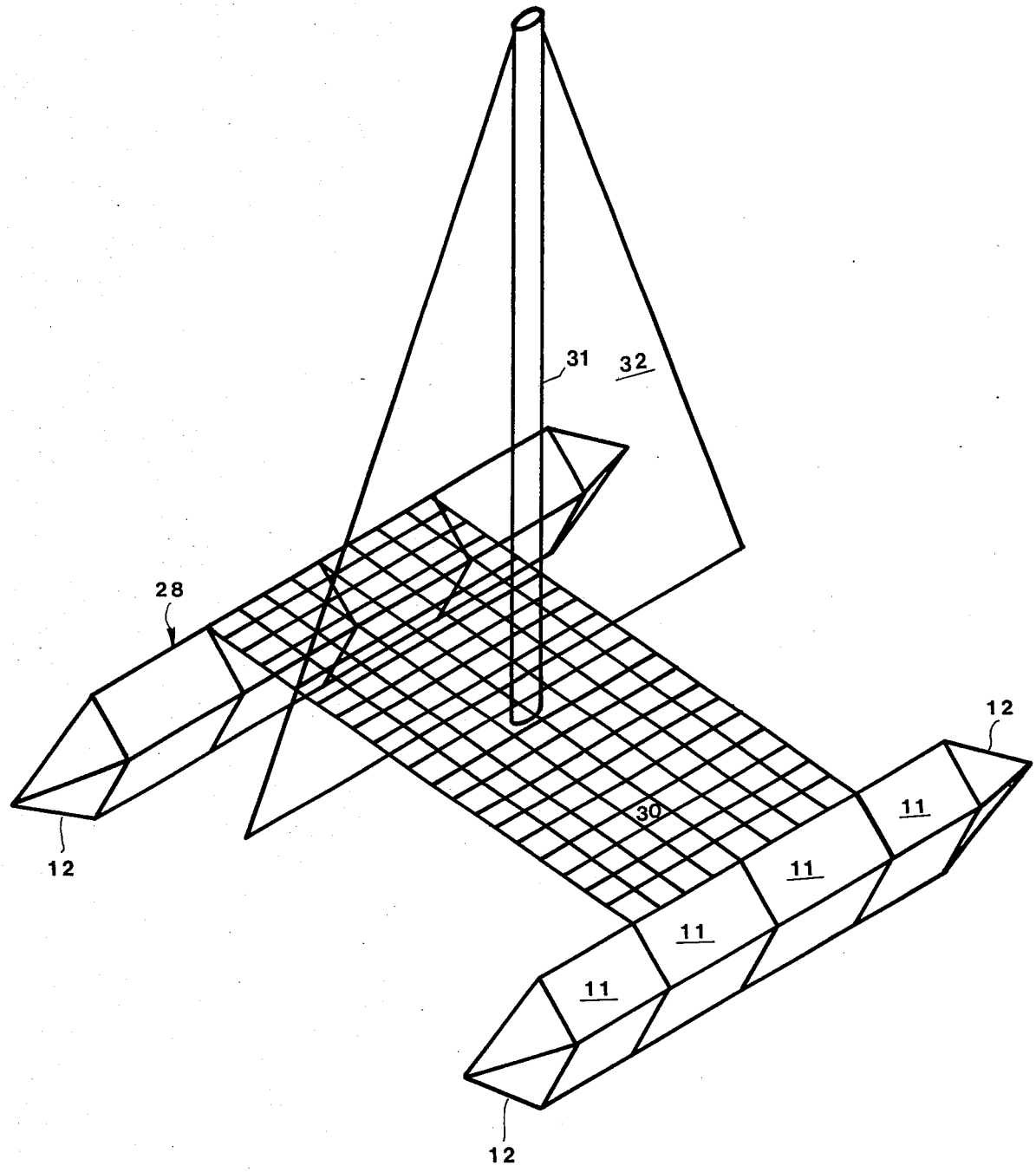
FIG. 5 is a perspective view of the catamaran boat of FIG. 4.

The catamaran boat 28 of FIGS. 4 and 5 is comprised of two of the above-described flotation hulls, each of four pontoon units, held in parallel disposition by cross arms 29 and associated deck structure 30. The hulls are maintained in an orientation such that first side corner 14 is downwardly directed in V-shaped disposition, placing second side corner 15 directly thereabove in a vertical plane, while third and fourth side corners 16 and 17, respectively, are disposed in a horizontal plane. The cross arms preferably penetrate the pontoons and are bolted to end walls 18.

The interiors of the pontoon units may be utilized as cabin quarters for personnel or equipment, in which case access doors are located in interiorly directed facing side panels 33. The catamaran is further equipped with standard features such as mast 31 and sails 32. Inother embodiments, three or four hulls may be utilized for the construction of the catamaran.

By virtue of the V-shaped configuration of the hulls, the catamaran has exceptionally good stability in the water. Because the hulls are constructed of flat panels, the necessary materials and methods of construction are commonly available, thereby resulting in very low cost of fabrication.

Alternative to the use of abutment strips 20, conventional metal angle bars 35, as indicated in FIG. 4, may be utilized within the interior of the pontoon unit adjacent long edges 21 and running the entire length thereof. When said angle bars are utilized, the side panels, whether of plywood, aluminum, plastic, or other material, may be bolted to the angle bars using preformed aligned holes in the bars and panels. In such embodiments, completely collapsible pontoon units and flotation hulls may be provided in compact kit form amenable to low cost warehousing and shipment. Such kits are particularly of military value because they can be dropped by parachute onto a beach area where assembly can be quickly and easily achieved.

To ensure water-impermeability of pontoons made by the bolting of panels to angle bars, rubber gasket strips may be interposed between the angle bars and the interior faces of the panels. An additional angle bar may be bolted to the exterior of the panels above the interior angle bars in order to provide extra durability and water-tightness to the corners of the pontoons.

In kit embodiments adapted to be assembled by the bolting of panels to internal angle bars, the corner of the pontoon which is intended to be disposed underwater may be provided with a water-impermeable hinge fabricated of plastic, rubber, or other material and running the entire length of said corner. Such hinged construction permits the panels of a kit to be shipped in partially assembled, folded configuration.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A flotation hull comprised of:

(a) at least one pontoon unit of block-like configuration comprised of four flat side walls of rectangular configuration joined at their edges to form four parallel side corners, and two bulkhead end walls positioned at the extremities of said side walls in perpendicular relationship thereto and forming end corners therewith, said end walls being adapted to permit joinder of adjacent pontoon units in a manner such that their end walls are in close parallel juxtaposition while the side walls of adjacent pontoon units are in coplanar alignment, and (b) a nose piece attached to each terminal end wall of a sequence of one or more pontoon units, said nose piece having a four sided pyramidal shape with a base periphery congruent with the end corners of said terminal end wall, the pointed extremities of said nose pieces being directed away from said pontoon units, (c) said hull being impervious to entrance of water into the interior thereof.

2. The flotation hull of claim 1 wherein said bulkhead end walls are of square configuration.

3. A boat comprised of at least one flotation hull of claim 1, said hull being oriented in a manner such that a first side corner of each pontoon unit is downwardly directed in V-shaped disposition, placing an opposite second side corner directly thereabove in a vertical plane, while the third and forth side corners are disposed in a horizontal plane.

4. The boat of claim 3 having at least two of said flotation hulls in parallel disposition.

5. The boat of claim 4 wherein said hulls are interconnected by cross arms which penetrate the hulls and attach to said bulkhead end walls.

6. The boat of claim 5 in the form of a catamaran boat.

7. The flotation hull of claim 1 wherein said pontoon units are fabricated of plywood panels, having interior and outer surfaces and being resistant to delamination by exposure to water.

8. The flotation hull of claim 7 wherein the plywood panels comprising said side walls are eight feet long and four feet wide.

9. The flotation hull of claim 7 wherein said panels are interconnected by attachment to strips of wood of rectangular cross-section placed in abutment with the interior surfaces of said panels adjacent said side corners.

10. The flotation hull of claim 1 comprised of 2 to 4 pontoon units.

11. The flotation hull of claim 1 wherein said walls are interconnected by bolted attachment to angle bars placed in abutment with the interior surfaces of said panels adjacent said side corners.

12. A kit adapted to be assembled to produce the flotation hull of claim 11, said kit being comprised of angle bars and panels having predrilled aligned holes which permit bolted assembly.

* * * * *